US005266737A

United States Patent [19]

Okamoto

[11] Patent Number: 5,266,737

[45] Date of Patent: Nov. 30, 1993

[54] POSITIONAL AND PRESSURE-SENSITIVE APPARATUS FOR MANUALLY CONTROLLING MUSICAL TONE OF ELECTRONIC MUSICAL INSTRUMENT

[75] Inventor: Tetsuo Okamoto, Hamamatsu, Japan

[73] Assignee: Yamaha Corporation, Hamamatsu, Japan

[21] Appl. No.: 636,292

[22] Filed: Dec. 31, 1990

[30] Foreign Application Priority Data

Jan. 10, 1990 [JP] Japan ..... 2-3069

[51] Int. Cl.[5] ..... G10H 1/02

[52] U.S. Cl. ..... 84/626; 84/DIG. 10; 84/630; 84/658; 338/114

[58] Field of Search ..... 84/626, 615, 173, DIG. 10, 84/630, 671, 644, 653, 658, 662, 670, 687, 690, 723, 742; 338/99, 114; 178/18

[56] References Cited

U.S. PATENT DOCUMENTS

| | | | |
|---|---|---|---|
| 4,257,305 | 3/1981 | Friend et al. | 338/114 |
| 4,430,917 | 2/1984 | Pepper, Jr. | 84/690 |
| 4,653,374 | 3/1987 | Iba | 84/626 |
| 4,810,992 | 3/1989 | Eventoff | 338/114 |
| 4,932,304 | 6/1990 | Franzmann | 84/671 |
| 4,961,363 | 10/1990 | Mizuno et al. | 84/626 |
| 4,982,644 | 1/1991 | Shibukawa | 84/627 |
| 4,984,276 | 1/1991 | Smith | 84/630 |
| 5,008,497 | 4/1991 | Asher | 178/18 |
| 5,117,730 | 6/1992 | Yamauchi | 84/723 |

*Primary Examiner*—William M. Shoop, Jr.
*Assistant Examiner*—Helen Kim
*Attorney, Agent, or Firm*—Graham & James

[57] ABSTRACT

A musical tone control apparatus controls an electronic musical instrument which simulates a natural musical instrument such as a bowed instrument. The apparatus includes an operator which can be movably operated in a predetermined direction and simulates a bow, a converter which stores a plurality of nonlinear characteristics. The nonlinear characteristics represent a relation between pressure signal which is added on the operator by a player and control pressure signal which simulates real rubbing pressure added on the string. To realize real performance by the bow, the converter converts the pressure signal into the control pressure signal to be changed in accordance with the position of the operator even if the pressure signal is constant.

7 Claims, 12 Drawing Sheets

POSITIONAL AND PRESSURE-SENSITIVE APPARATUS FOR MANUALLY CONTROLLING MUSICAL TONE OF ELECTRONIC MUSICAL INSTRUMENT

BACKGROUND OF THE INVENTION

1. Field of the Invention

The present invention relates to a musical tone control apparatus suitable for imitating a performance expression of an acoustic musical instrument such as a bowed instrument.

2. Description of the Prior Art

As a conventional electronic musical instrument which can control musical tone characteristics such as tone colors, tone volumes, and the like in accordance with, e.g., an operation pressure, an instrument which detects a key depression pressure during a key depression operation at a keyboard, and controls a sustaining waveform of a musical tone is known.

In general, in bowed instruments such as a violin, a cello, a viola, and the like, when a string is rubbed with a bow, it is easier to produce a strong tone with a base side of the bow than with a tip side of the bow. For this reason, during an actual performance, a player selectively uses the base side and the tip side of the bow, or initially brings the bow in contact with a string from the base side and then pulls it, or initially brings the bow in contact with a string from the tip side and then pushes it, thus realizing so-called down-bow and up-bow performance expressions. As a result, a player can add a variety of expressions to musical tones.

In contrast to this, in the conventional electronic musical instrument, although musical tone characteristics can be varied by adjusting a depression force for keys, keys cannot be moved, and musical tone control under a condition of movement of an operation member like in a bow operation cannot be performed. In particular, differences in operation positions or differences of operation directions cannot be reflected in musical tones.

SUMMARY OF THE INVENTION

It is an object of the present invention to provide a musical tone control apparatus which can achieve various performance expressions approximate to an acoustic musical instrument such as a bowed instrument.

A musical tone control apparatus according to the present invention comprises (a) an operation member which can be movably operated, (b) first detection means for detecting position data according to an operation position along a moving direction of the operation member, (c) second detection means for detecting pressure data according to an operation pressure along the moving direction of the operation member, (d) conversion means for converting the pressure data from the second detection means into control pressure data on the basis of the position data from the first detection means, the conversion means performing conversion such that a value of the control pressure data is changed along the moving direction if an operation pressure along the moving direction of the operation member is assumed to be constant, and (e) control means for controlling musical tone characteristics in accordance with the control pressure data from the conversion means.

According to the arrangement of the present invention, for example, when an operation member is reciprocally operated, musical tone characteristics can be controlled in accordance with control pressure data in both the forward and reverse directions. When pressure data is converted into control pressure data on the basis of position data, conversion is performed so that if an operation pressure along a moving direction of the operation member is assumed to be constant, the value of the control pressure data is changed (e.g., increased or decreased) along the moving direction. Therefore, differences in operation positions and differences in operation directions can be reflected in musical tones. As a result, performance expressions approximate to down-bow and up-bow expressions can be attained.

DETAILED DESCRIPTION OF THE PREFERRED EMBODIMENTS

Figure 1:
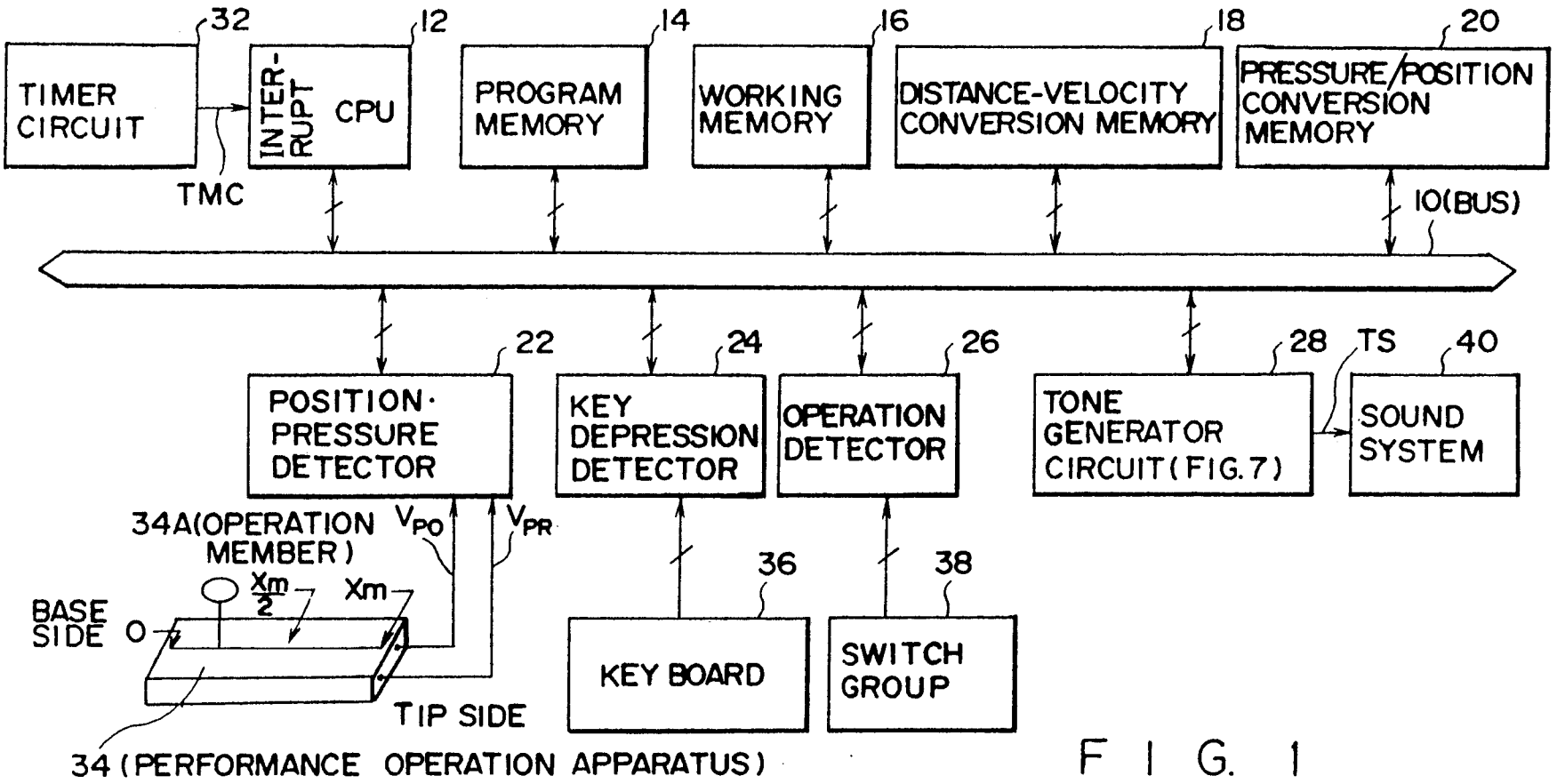
FIG. 1 is a block diagram showing an embodiment wherein the present invention is applied to an electronic musical instrument.

FIG. 1 shows an arrangement of an electronic musical instrument according to an embodiment of the present invention. Musical tone generation of this electronic musical instrument is controlled by a microcomputer. Note that in FIGS. 1, 7, and 8, hatched signal lines represent that they include a plurality of signal lines or data including a plurality of bits are to be transmitted therethrough.

Circuit Arrangement (FIG. 1)

A bus 10 is connected to a central processing unit (CPU) 12, a program memory 14, a working memory 16, a distance-velocity conversion memory 18, a pressure/position conversion memory 20, a position-pressure detector 22, a key depression detector 24, an operation detector 26, a tone generator circuit 28, and the like.

The CPU 12 executes various processing operations for musical tone generation in accordance with a program stored in the memory 14. These processing operations will be described later with reference to FIGS. 13 to 16. The CPU 12 has a timer circuit 32. The timer circuit 32 supplies a timer clock signal TMC having a clock cycle of 1 to 10 ms, and preferably 3 ms, to the CPU 12 as an interrupt command signal.

The working memory 16 includes a large number of registers which are used during the various processing operations of the CPU 12, and registers associated with the embodiment of the present invention will be described later.

The position-pressure detector 22 has a performance operation apparatus 34 having an operation member 34A. The apparatus 34 can detect an operation position and an operation pressure of the operation member 34A when the operation member 34A is slidably operated along the longitudinal direction of the apparatus 34, and has an arrangement, as shown in, e.g., FIG. 2.

Figure 2:
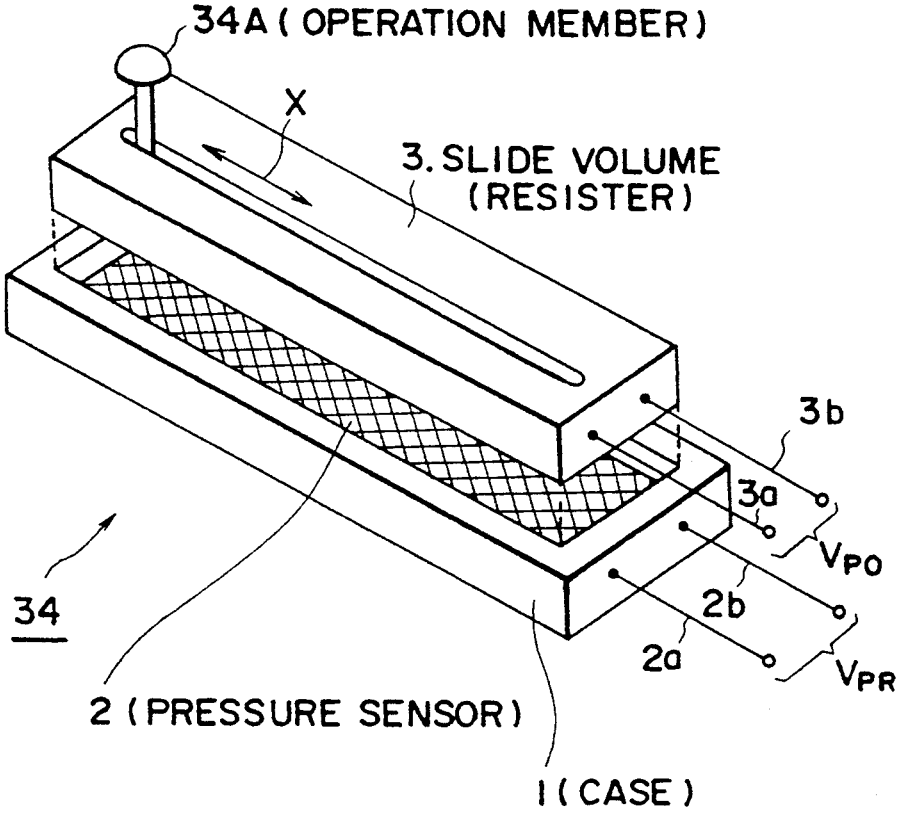
FIG. 2 is an exploded perspective view showing a structure of a performance operation apparatus.

In the apparatus shown in FIG. 2, a flat pressure sensor 2 is arranged on the bottom surface of a box-like case 1 having an upper opening, and a slide resistor 3 is vertically movably housed in the case 1 to be overlaid on the pressure sensor 2. In the slide resistor 3, the operation member 34A is coupled to a slider (not shown). Thus, a player can hold the operation member 34A to reciprocally slide the slider along the longitudinal direction (direction of an arrow x) of the resistor 3.

When a slide operation is performed by the operation member 34A, a voltage signal $V_{PO}$ corresponding to an operation position can be extracted from a pair of terminals 3a and 3b of the resistor 3, and a voltage signal $V_{PR}$ corresponding to an operation pressure can be extracted from a pair of terminals 2a and 2b of the pressure sensor 2. Note that operation positions along the longitudinal direction of the apparatus 34 are expressed by coordinate values 0 to $X_m/2$ to $X_m$, as shown in FIG. 1, for the sake of simplicity.

The position-pressure detector 22 detects the voltage signal $V_{PO}$ corresponding to an operation position, and the voltage signal $V_{PR}$ corresponding to an operation pressure from the performance operation apparatus 34, and converts these voltage signals $V_{PO}$ and $V_{PR}$ into digital position data and pressure data, respectively.

Figure 3:
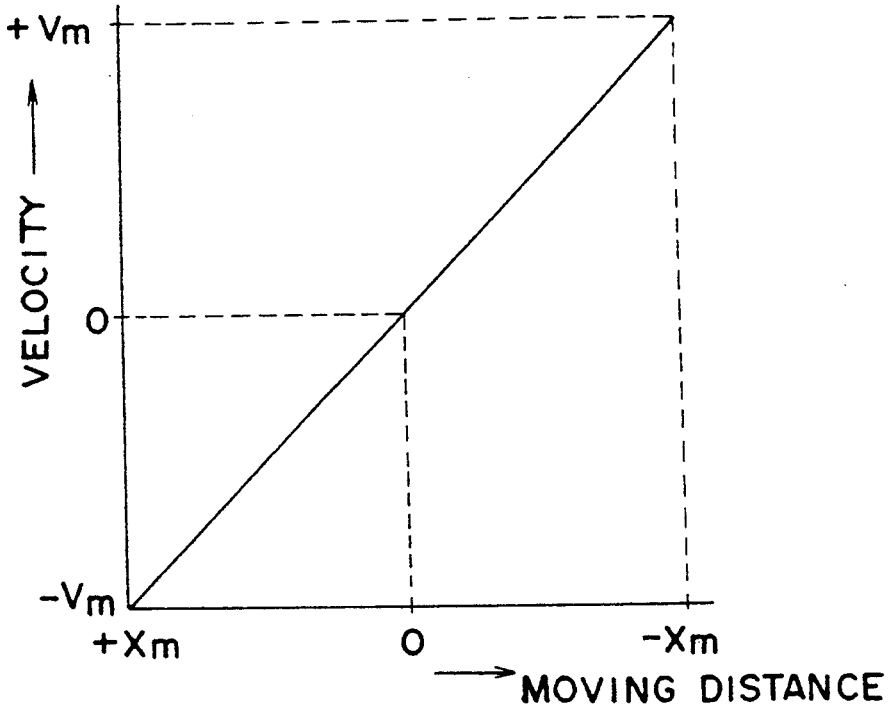
FIG. 3 is a graph for exemplifying conversion characteristics of a memory 18.

The distance-velocity conversion memory 18 converts a moving distance (operation velocity) per unit time obtained on the basis of the position data from the detector 22 into velocity data in accordance with conversion characteristics shown in FIG. 3.

Figure 4:
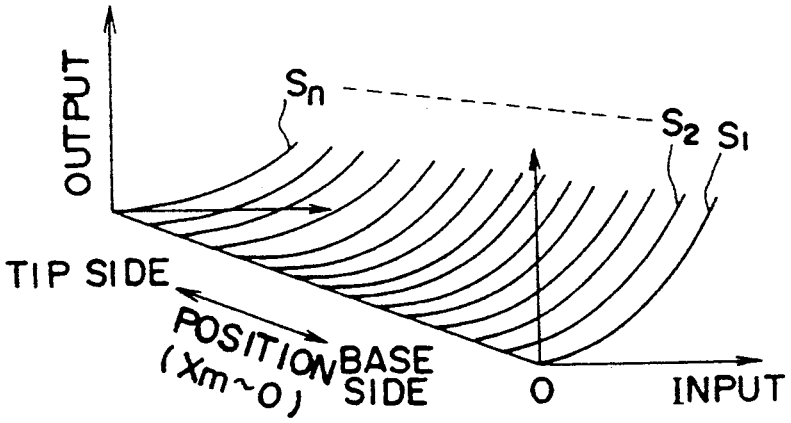
FIG. 4 to 6 are graphs for exemplifying conversion characteristics of a memory 20.

The pressure/position conversion memory 20 converts the pressure data from the detector 22 into tone generator control pressure data on the basis of the position data from the detector 22. For example, the memory 20 stores tone generator control pressure data according to conversion characteristics expressed by curves $S_1$ to $S_n$ respectively corresponding to positions O to $X_m$, as shown in FIG. 4. These conversion characteristics are expressed by nonlinear curves $S_1$ to $S_n$ to match with feelings of individual players, and are determined so that if an operation pressure, which is added on the operation member 34A, is assumed to be constant, a value of tone generator control pressure data is decreased as an operation position changes like O to $X_m$. This characteristic simulates that of the bowed instrument, i.e., a rubbing-pressure, which is really added on a string through a bow by a player, varies along a direction of the bow, even if a bow-pressure, which is added on the bow by a player, is constant. For example, the bow-pressure at a tip side of the bow is smaller than that at a base side. In this case, a position closer to O corresponds to the base side of a bow, and a position closer to $X_m$ corresponds to the tip side of the bow.

When the position data indicates a specific position, conversion characteristics corresponding to the indicated position are read out and designated, and pressure data (input) is converted to tone generator control pressure data (output) in accordance with the designated conversion characteristics.

Figure 5:
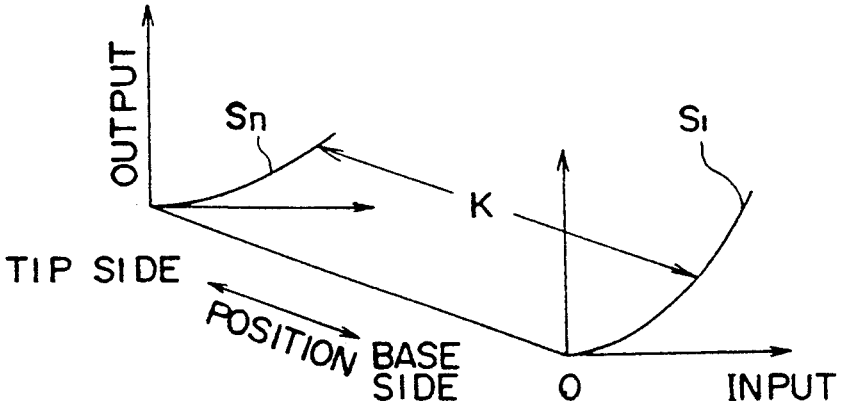
Figure 6:
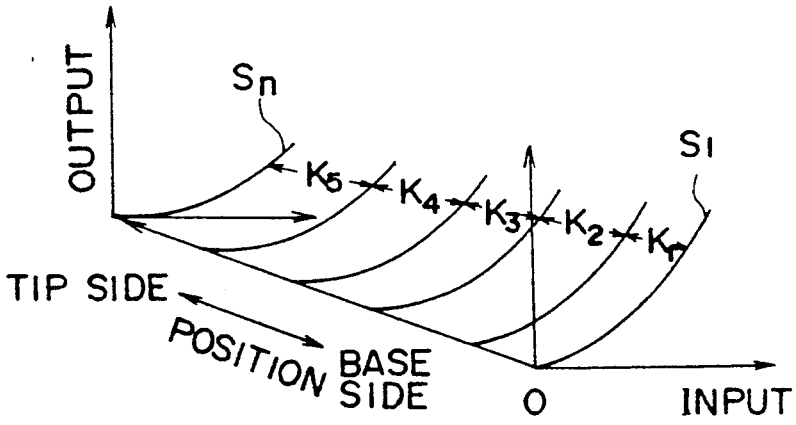

In FIG. 4, the conversion characteristics are stored in units of positions. Alternatively, as shown in FIG. 5, two conversion characteristics expressed by curves $S_1$ and $S_n$ corresponding to positions O and $X_m$ may be stored, and tone generator control pressure data for a period K between the two positions may be generated by interpolation calculations. Alternatively, as shown in FIG. 6, conversion characteristics corresponding to three or more positions may be stored, and tone generator control pressure data for periods $K_1$ and $K_5$ may be generated by interpolation calculations.

As still another method, tone generator control pressure data may be generated by only calculations. For example, if a value of position data is represented by X, its maximum value is represented by $X_m$, a value of pressure data is represented by P, and its maximum value is represented by $P_m$, a value PC of tone generator control pressure data can be calculated by the following equation:

$$PC = \frac{1}{2}\left(2 - \frac{X}{Xm}\right) \times \left(\frac{P}{Pm}\right)^2$$

The key depression detector 24 detects key depression data (key ON/OFF data and key code data) in units of keys of a keyboard 36.

The operation detector 26 detects operation data in units of switches in a switch group 38 including, e.g., a tone volume setting switch.

The tone generator circuit 28 forms and outputs a musical tone signal TS on the basis of the velocity data, the tone generator control pressure data, the key depression data, and the like mentioned above, and will be described in detail later with reference to FIG. 7.

The musical tone signal TS from the tone generator circuit 28 is supplied to a sound system 40 including an output amplifier, a loudspeaker, and the like, and is produced as an actual musical tone.

Figure 7:
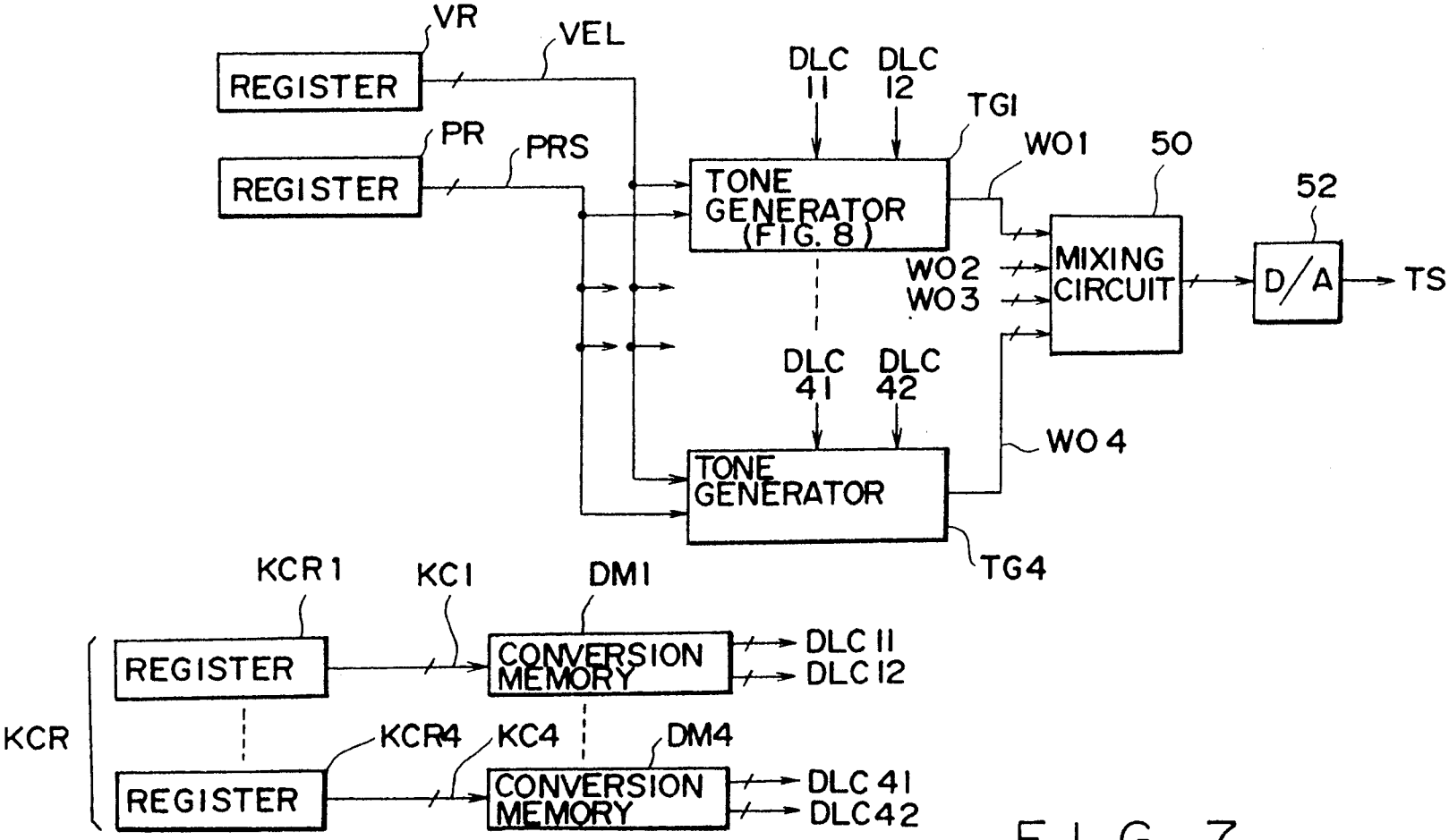
FIG. 7 is a circuit diagram showing an arrangement of a tone generator circuit 28.

Tone Generator Circuit 28 (FIG. 7)

FIG. 7 shows an arrangement of the tone generator circuit 28, and the circuit 28 includes four tone generators TG1 to TG4 corresponding to four strings of a violin Therefore, in this embodiment, a maximum of four tones can be simultaneously generated. The tone generators TG1 to TG4 have the same arrangement, and perform the same operation. Thus, the arrangement and operation of the tone generator TG1 will be exemplified later.

A register VR stores the velocity data read out from the memory 18. Velocity data VEL outputted from this register is supplied to the tone generators TG1 to TG4. A register PR stores the tone generator control pressure data read out from the memory 20. Pressure data PRS from this register is supplied to the tone generators TG1 to TG4.

Registers KCR1 to KCR4 are arranged in correspondence with the tone generators TG1 to TG4, and store key code data (pitch data) corresponding to keys depressed at the keyboard 36. Key code data KC1 to KC4 from the registers KCR1 to KCR4 are supplied to key code-delay amount conversion memories DM1 to DM4.

Each of the conversion memories DM1 to DM4 stores first and second delay amount data in units of keys of the keyboard 36. The first and second delay amount data for a given key are used to distribute a total delay amount corresponding to a pitch of the given key to first and second delay means (e.g., 60 and 68 in FIG. 8) at a predetermined distribution ratio. If the total delay amount (e.g., the number of delay stages) is represented by D and the distribution ratio is represented by K (K is a value falling within a range of $0<K<1$, and is, e.g., 0.5), the first delay data expresses a delay amount given by $D\times K$, and the second delay amount data expresses a delay amount given by $D\times(1-K)$.

For example, the conversion memory DM1 converts input key code data KC1 into first and second delay amount data DLC11 and DLC12 corresponding to a pitch, and supplies these data to the tone generator TG1. Note that if the value of the register KCR1 is 0 (i.e., no key code data), data for disabling the first and second delay means of the tone generator TG1 are supplied as the data DLC11 and DLC12.

As for the remaining tone generators TG2 to TG4, delay amount data DLC21, DLC22, . . . , DLC41, and DLC42 are supplied in the same manner as in the tone generator TG1.

The tone generators TG1 to TG4 generate digital musical tone waveform data on the basis of the tone generator control data supplied as described above. Musical tone waveform data WO1 to WO4 from the tone generators TG1 to TG4 are mixed by a mixing circuit 50. Musical tone waveform data from the mixing circuit 50 is converted into an analog musical tone signal TS by a digital-to-analog (D/A) converter 52. The musical tone signal TS is supplied to the sound system 40 (FIG. 1).

Figure 8:
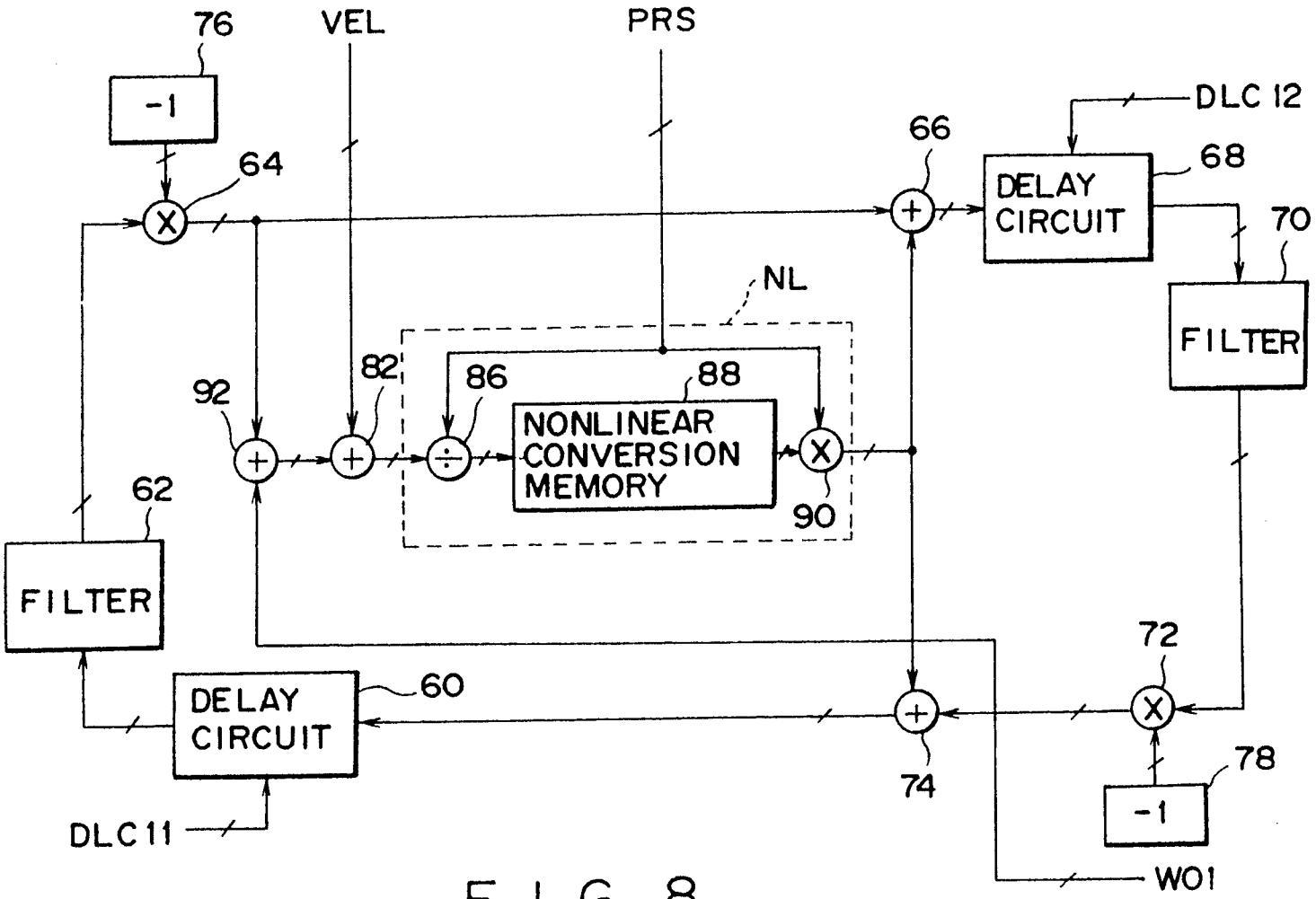
FIG. 8 is a circuit diagram showing an arrangement of a tone generator TG1.

Tone Generator TG1 (FIG. 8)

FIG. 8 shows an arrangement of the tone generator TG1. The tone generator TG1 can imitate a bowed string tone.

A variable delay circuit 60, a filter 62, a multiplier 64, an adder 66, a variable delay circuit 68, a filter 70, a multiplier 72, and an adder 74 are connected to form a closed loop, thus constituting a data circulating path. A total delay time of the data circulating path corresponds to the length of a string (vibrator), i.e., a fundamental wave cycle of a tone to be generated. A propagation/-distribution state of a vibration on the string is expressed by waveform data which circulates through the data circulating path.

The delay circuits 60 and 68 are set and controlled, so that their delay amounts are equal to values indicated by the delay amount data DLC11 and DLC12, respectively. A pitch corresponding to the total delay amount of the delay circuits 60 and 68 is provided to waveform data which circulates through the data circulating path. Strictly speaking, since a pitch of a musical tone to be generated is determined by a total sum of delay amounts in the closed loop, the total delay amount of the circuits 60 and 68 is determined in consideration of delay amounts of the filters and the like in the closed loop in advance, thus obtaining a pitch corresponding to the total delay amount.

The filters 62 and 70 are used to imitate a loss corresponding to a vibration propagation due to a material of a string, and to imitate nonlinearity of a propagation velocity with respect to a frequency. For the former imitation, a low-pass filter is employed. For the latter imitation, an all-pass filter is employed, and generation of fractional-order overtones can be realized by utilizing the fact that frequency vs. delay characteristics of the all-pass filter have nonlinearity.

The multipliers 64 and 72 multiply negative coefficients from coefficient generators 76 and 78 with circulating waveform data to imitate phase inversion corresponding to reflection of a vibration wave at one and the other ends of a string. In this case, the negative coefficients are set to be $-1$ if it is assumed that there is no loss at the fixed ends of a string, or are selected from a range of 0 to $-1$ in correspondence with losses if it is assumed that there are steady losses at the fixed ends of a string. These coefficients may be changed over time as needed.

The adders 66 and 74 are used to introduce excitation waveform data from a nonlinear conversion unit NL to the data circulating path.

The velocity data VEL is supplied to the nonlinear conversion unit NL via an adder 82. The conversion unit NL is arranged to imitate a nonlinear change of a bowed string, and comprises a divider 86 for receiving an output from the adder 82, a nonlinear conversion memory 88 for receiving an output from the divider 86, and a multiplier 90 for receiving an output from the memory 88. The divider 86 and the multiplier 90 receive the tone generator control pressure data PRS, and the multiplier 90 outputs the excitation waveform data.

Figure 9:
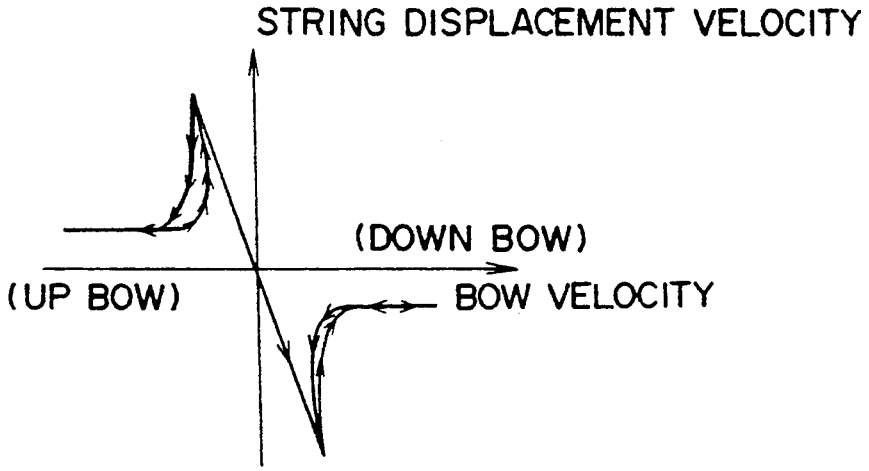
FIG. 9 is a graph for exemplifying a nonlinear change of a bowed string.

FIG. 9 shows a nonlinear change of a bowed string. A velocity of a bow relative to a string is plotted along the abscissa, and a displacement velocity given from the bow to the string is plotted along the ordinate. As is well known, when a bow velocity is near 0, a string displacement velocity is linearly increased as the bow velocity is increased since a contribution of a static friction is dominant. When a predetermined external force or higher is applied, a dynamic friction becomes dominant, and the contribution of the external force to the bow displacement velocity is decreased immediately, thus obtaining a nonlinear change, as shown in FIG. 9. It is also known that a hysteresis phenomenon shown in FIG. 9 occurs during a transition between the static friction and the dynamic friction.

Figure 10:
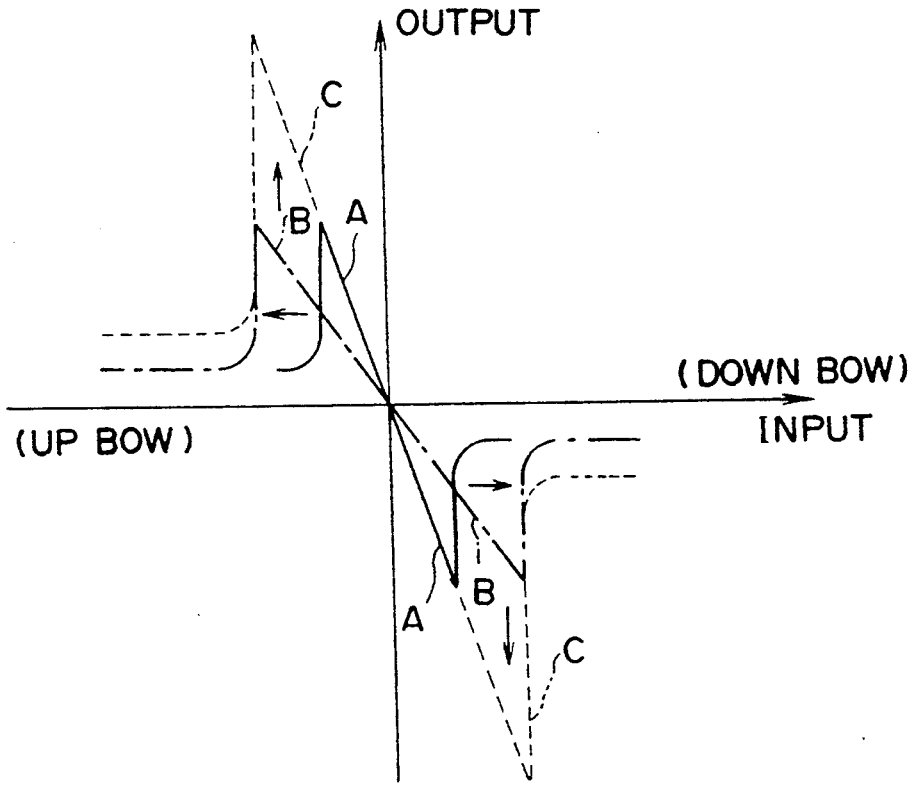
FIG. 10 is a graph for exemplifying a change in characteristics in a nonlinear conversion unit NL.

In order to imitate a nonlinear change shown in FIG. 9, the nonlinear conversion memory 88 stores numerical value data according to conversion characteristics expressed by a solid curve A in FIG. 10. In order to imitate a change in static friction region according to a bow pressure, the divider 86 and the multiplier 90 are arranged at the input and output sides of the memory 88, respectively, to perform division and multiplication with the pressure data PRS. When input data to the memory 88 is divided with the pressure data PRS, the characteristics represented by the curve A in FIG. 10 are converted to characteristics represented by an alternate long and short dashed curve B in FIG. 10. When output data from the memory 88 is multiplied with the pressure data PRS, the characteristics expressed by the curve B in FIG. 10 are converted to characteristics represented by a broken curve C in FIG. 10. In order to change characteristics according to the pressure data PRS, the present invention is not limited to the above-mentioned calculation method. For example, conversion characteristics may be stored in units of pressure values, and conversion characteristics to be used may be designated according to the pressure data PRS.

Figure 11:
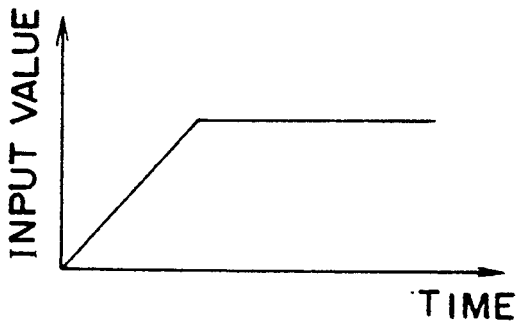
FIGS. 11 and 12 are waveform charts showing inputs and outputs of the nonlinear conversion unit NL.
Figure 12:
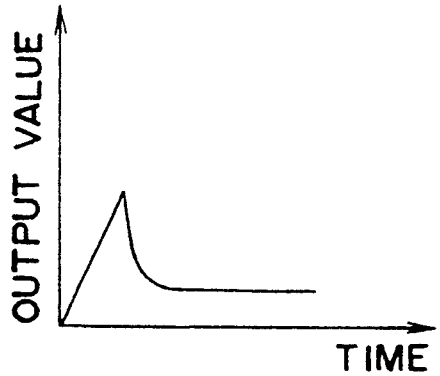

For example, when velocity data representing a change over time shown in FIG. 11 is inputted to the nonlinear conversion unit NL, excitation waveform data shown in FIG. 12 can be outputted from the nonlinear conversion unit NL, and is inputted to the data circulating path via the adders 66 and 74.

An adder 92 adds the outputs from the multipliers 64 and 72, and supplies the sum to the adder 82. Since the adder 92 is arranged, circulating waveform data is inputted again to the data circulating path via the nonlinear conversion unit NL, and a complicated change in waveform can be obtained.

The musical tone waveform data WO1 consisting of circulating waveform data is outputted from the output side of the multiplier 72. The output position is not limited to one shown in FIG. 8, but may be any other positions as long as waveform data can be circulated. The waveform data need not always be outputted from only one position but may be outputted from a plurality of positions and then mixed to obtain final data.

Since the above-mentioned tone generator TG1 has a delay loop structure including the filters, it exhibits so-called comb filter characteristics. When excitation waveform data expressing the relationship between a string and a bow is inputted from the nonlinear conversion unit NL to the data circulating path, waveform data representing an overtone spectrum pattern according to a resonance peak frequency of the comb filter circulates through the data circulating path.

The tone generator TG1 generates the musical tone waveform data WO1 under a condition that it receives the velocity data VEL and the pressure data PRS, and also receives the data DLC11 and DLC12 which represent delay amounts. Therefore, when none of keys at the keyboard 36 are depressed, or when no key code data is set in the register KCR1 even if a key is depressed, no musical tone waveform data is generated even if the operation member 34A of the performance operation apparatus 34 is slid. Even when key code data is set in the register KCR1, no musical tone waveform data is generated unless the operation member 34A is slid.

When a slide operation of the operation member 34A is started in a state wherein key code data is set in the register KCR1, a variety of expressions can be given to the rising waveform of a musical tone depending on the way of applying an operation force at that time (e.g., quickly or gradually). When an operation velocity and/or an operation pressure are/is adjusted during generation of a musical tone, a variety of expressions can also be given to a musical tone. In addition, a variety of expressions can be given to the falling waveform of a musical tone depending on the way of disabling an operation force (e.g., quickly or gradually) when a decay of the musical tone is started later.

Expressions can be also added to a musical tone when key code data is set in the register KCR1 according to a key depression operation after the slide operation of the operation member 34A is started.

When the register KCR1 is cleared according to a key OFF event during generation of a musical tone, since the delay circuits 60 and 68 are disabled, the musical tone is quickly decayed. When the slide operation of the operation member 34A is stopped without clearing the register KCR1 during generation of a musical tone, since circulating waveform data suffers from a loss of the circulating path, the musical tone is gradually decayed. Therefore, two different decay modes, i.e., quick and slow decay modes can be obtained.

Decay control upon a key OFF event need not always be attained by disabling the delay circuits 60 and 68. For example, a variable attenuator may be inserted in the data circulating path, and its degree of attenuation may be increased upon detection of a key OFF event, or the gain of the filter 62 and/or the gain of the filter 70 may be controlled to be decreased upon detection of a key OFF event. Thus, various other methods may be employed.

Working Memory 16

Of the registers in the working memory 16, ones associated with the embodiment of the present invention are as follows.

(1) Key code register KCD . . . This register stores key code data corresponding to a key associated with event detection every time a key ON or key OFF event is detected through the detector 24.

(2) Tone generator ON/OFF register KOR . . . This register includes four registers KOR1 to KOR4 corresponding to the registers KCR1 to KCR4 shown in FIG. 7, and if a content of a register is "1", it represents that a corresponding tone generator is generating a tone; if it is "0", it represents that the corresponding tone generator is not generating a tone.

(3) Position register POS1 . . . This register is set with position data from the detector 22.

(4) Pressure register PRES1 . . . This register is set with pressure data from the detector 22.

(5) Old position register POS2 . . . This register is set with the position data from the register POS1. The content of the register POS1 represents an operation position at the present timer interruption, while the content of the register POS2 represents an operation position at the previous timer interruption.

(6) Old pressure register PRES2 . . . This register is set with the pressure data from the register PRES1. The content of the register PRES1 represents a pressure value corresponding to an operation pressure at the present timer interruption, while the content of the register PRES2 represents a pressure value corresponding to an operation pressure at the previous timer interruption.

(7) Distance register DIST . . . This register is set with a difference (moving distance per unit time) obtained by subtracting the value of the register POS1 from that of the register POS2.

Figure 13:
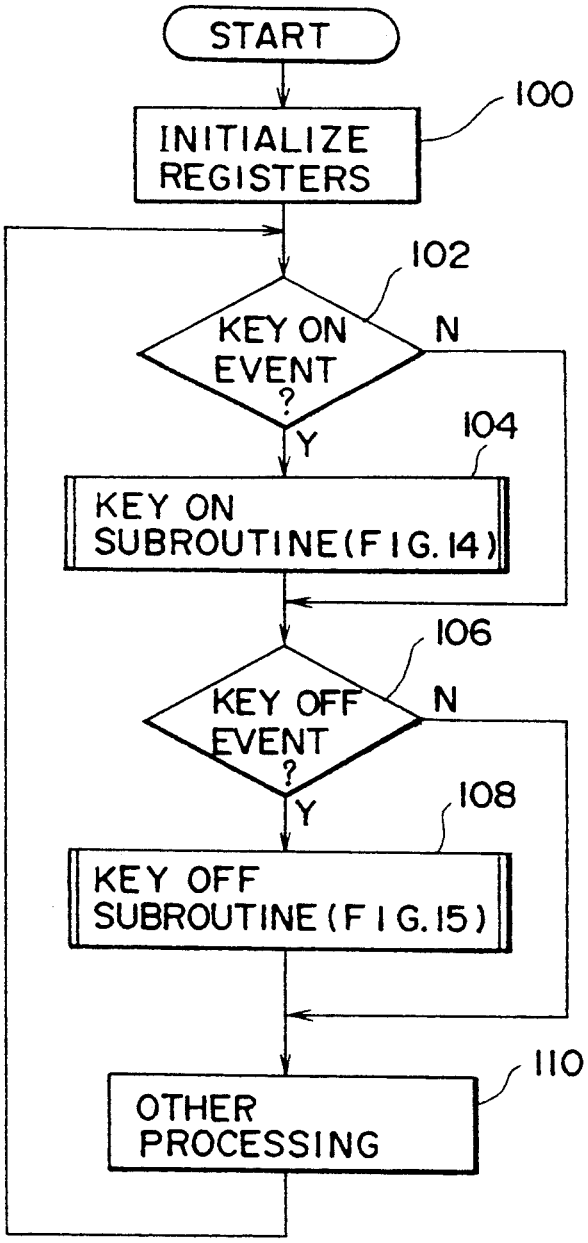
FIG. 13 is a flow chart showing a main routine.

Main Routine (FIG. 13)

FIG. 13 shows a processing flow of the main routine, and this routine is started when, e.g., a power switch is turned on.

In step 100, various registers are initialized. For example, the registers (1) to (4), (6), and (7) are cleared, and position data from the detector 22 is set in the register POS2. The flow then advances to step 102.

It is checked in step 102 if a key ON event at the keyboard 36 is detected. If Y (YES) in step 102, a key ON subroutine is executed in step 104, as will be described later with reference to FIG. 14.

If N (NO) in step 102, or if the processing in step 104 is ended, the flow advances to step 106 to check if a key OFF event at the keyboard 36 is detected. If Y in step 106, the flow advances to step 108, and a key OFF subroutine is executed, as will be described later with reference to FIG. 15.

If N in step 106, or if the processing in step 108 is ended, the flow advances to step 110, and other processing (e.g., tone volume setup processing, and the like) is executed. Thereafter, the flow returns to step 102, and the above-mentioned processing operations are similarly repeated.

Figure 14:
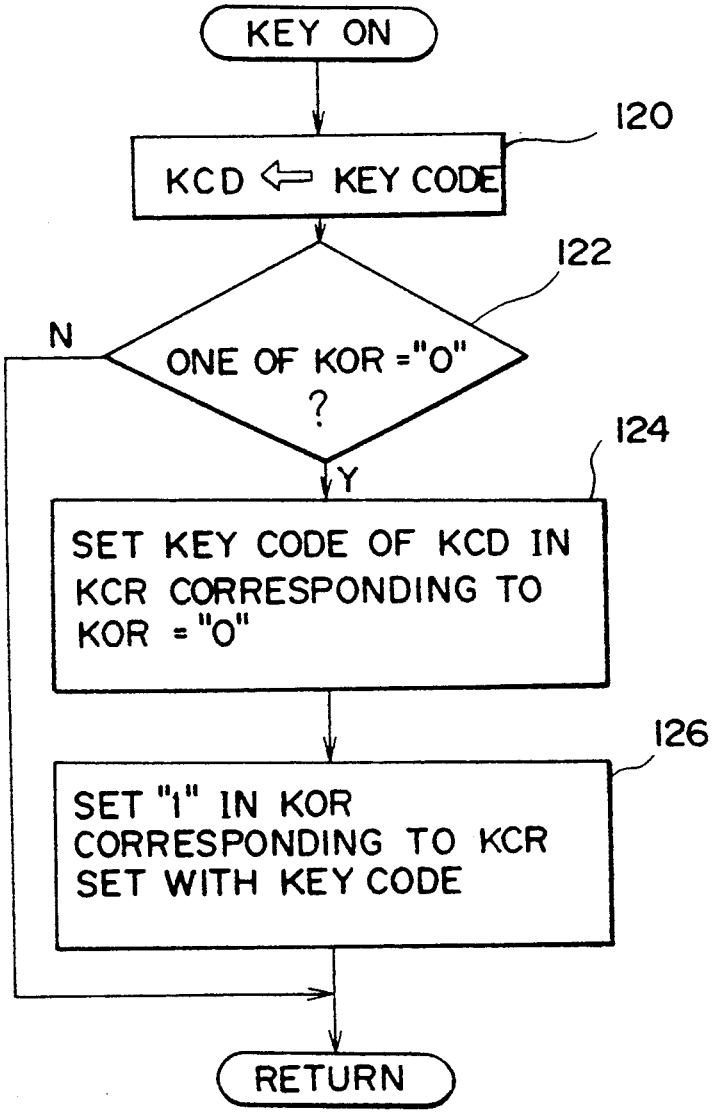
FIGS. 14 and 15 are flow charts showing key ON and key OFF subroutines.

Key ON Subroutine (FIG. 14)

FIG. 14 shows the key ON subroutine. In step 120, a key code associated with the detected key ON event is set in the register KCD. The flow then advances to step 122.

It is checked in step 122 if any one of contents of the registers KOR is "0". If N in step 122, since all the tone generators are in use, the flow returns to the main routine shown in FIG. 13 without executing key code assignment processing.

If Y in step 122, the flow advances to step 124, and the key code stored in the register KCD is set in one of the registers KCR (KCR1 to KCR4 in FIG. 7) corresponding to the register KOR whose content is determined as "0". The flow then advances to step 126.

In step 126, "1" is set in the register KOR corresponding to the register KCR set with the key code. The flow then returns to the main routine shown in FIG. 13.

According to the subroutine shown in FIG. 14, for example, if the register KOR1 is "0", a key code is set in the register KCR1, and "1" is set in the register KOR1, thus allowing musical tone generation of the tone generator TG1.

Figure 15:
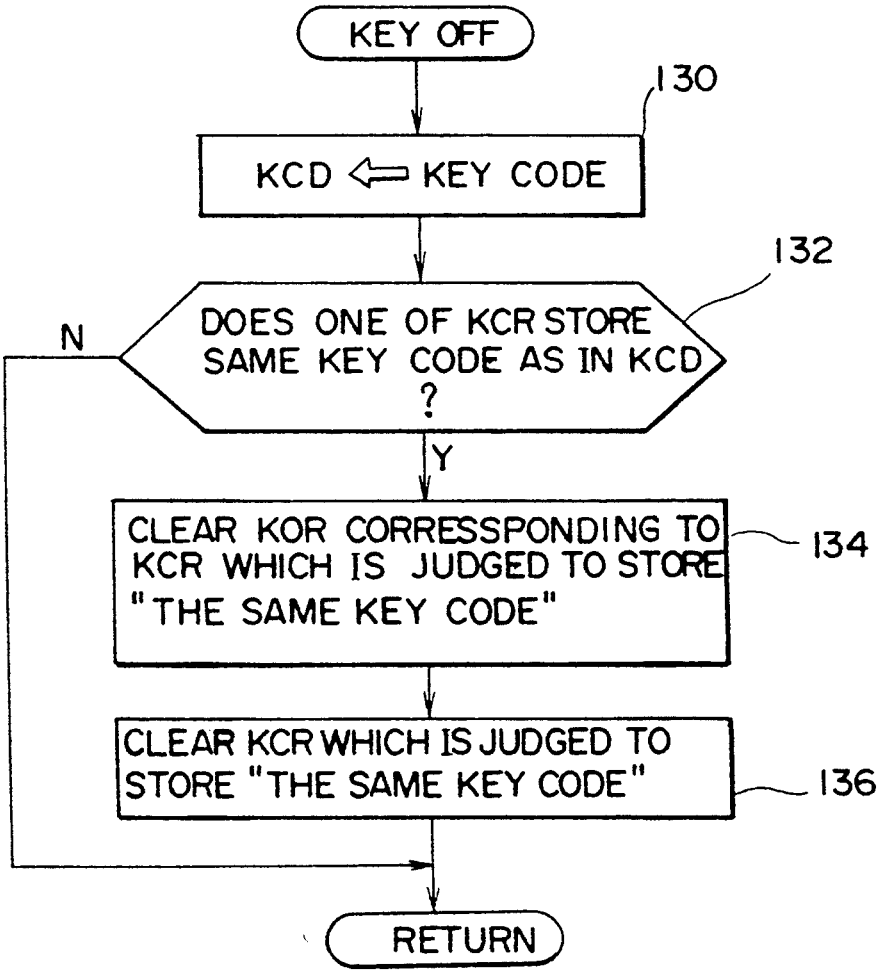

Key OFF Subroutine (FIG. 15)

FIG. 15 shows the key OFF subroutine. In step 130, a key code associated with the detected key OFF event is set in the register KCD. The flow then advances to step 132.

It is checked in step 132 if any one of the registers KCR stores the same key code as that in the register KCD. If N in step 132, since a musical tone corresponding to a key OFF event key is not being generated, and no key OFF processing is necessary, the flow returns to the main routine shown in FIG. 13.

If Y in step 132, the flow advances to step 134, and the register KOR corresponding to the register KCR which stores the same key code is cleared (set to be "0"). In step 136, the register KCR which stores the same key code is cleared, and the flow returns to the main routine shown in FIG. 13.

According to the subroutine shown in FIG. 15, if the register KCR1 stores the same key code as that stored in the register KCD, both the registers KOR1 and KCR1 are cleared. In response to the zero clear operation of the register KCR1, in the tone generator TG1, the delay circuits 60 and 68 shown in FIG. 8 are disabled, and a musical tone in generation begins to be decayed.

Figure 16:
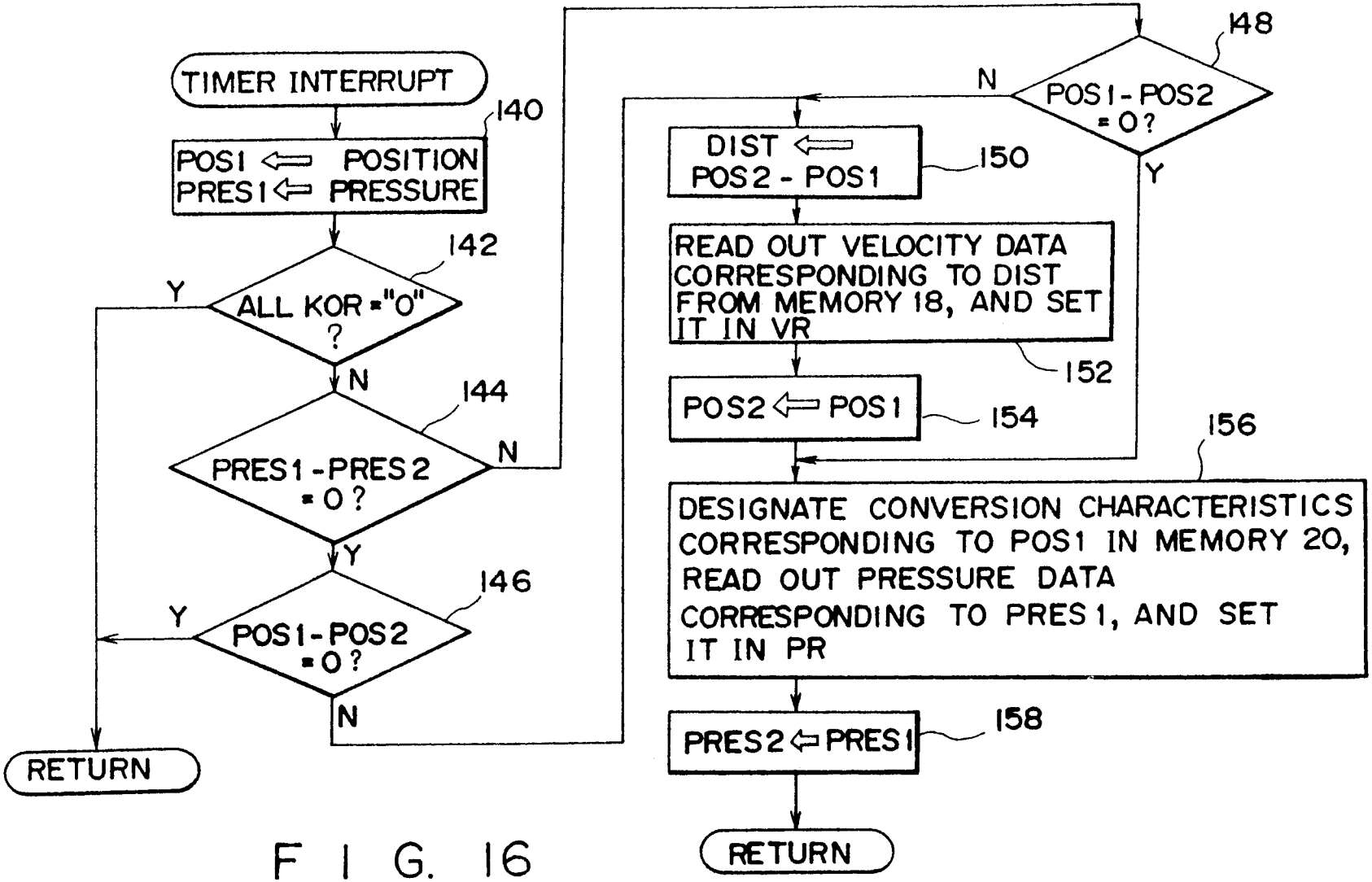
FIG. 16 is a flow chart showing a timer interrupt routine.

Timer Interrupt Routine (FIG. 16)

FIG. 16 shows the timer interrupt routine. This routine is started in response to each clock pulse of the timer clock signal TMC, e.g., at a cycle of 3 ms.

In step 140, position data and pressure data from the detector 22 are respectively set in the registers POS1 and PRES1.

It is checked in step 142 if all the registers KOR are "0". If Y in step 142, since none of the tone generators generate musical tones, and no processing is necessary, the flow returns to the main routine shown in FIG. 13.

If N in step 142, the flow advances to step 144 to check if a difference obtained by subtracting the value of the register PRES2 from the value of the register PRES1 is 0 (no change in pressure). If Y in step 144, the flow advances to step 146 to check if a difference obtained by subtracting the value of the register POS2 from the value of the register POS1 is 0 (no change in position). If Y in step 146, since processing to be described below is unnecessary, the flow returns to the main routine shown in FIG. 13.

If N in step 144, the flow advances to step 148 to check if there is no change in position like in step 146. If N in step 148, since this means that both the pressure and velocity are changed, the flow advances to step 150.

In step 150, the difference obtained by subtracting the value of the register POS2 from the value of the register POS1 is set in the register DIST. When step 150 is executed for the first time after the power switch is turned on, since the initial position of the operation member 34A is set in the register POS2 in step 100, a moving distance from the initial position to the present timer interrupt position is set in the register DIST.

In step 152, velocity data corresponding to the value of the register DIST is read out from the memory 18, and is set in the register VR (FIG. 7). The flow advances to step 154, and the value of the register POS1 is set in the register POS2.

According to the processing operations in steps 150 to 154, a velocity can be designated according to a moving distance per unit time (operation velocity), as shown in FIG. 3. For example, when the operation member 34A of the performance operation apparatus 34 is moved to the right, the sign of the difference (POS2−POS1) becomes negative, and a positive velocity value can be obtained in FIG. 3. This corresponds to a bow velocity or input in a pull direction in FIG. 9 or 10. When the operation member 34A is moved to the left, the sign of the difference becomes positive, and a negative velocity value can be obtained in FIG. 3. This corresponds to a bow velocity or input in a push direction in FIG. 9 or 10.

Upon completion of the processing in step 154, the flow advances to step 156. In step 156, conversion characteristics corresponding to the position indicated by the register POS1 are read out and designated. Tone generator control pressure data corresponding to the pressure data in the register PRES1 is read out from the tone generator control pressure data group according to the designated conversion characteristics, and is set in the register PR (FIG. 7). As a result, tone generator control can be executed based on pressure data matching with an operation pressure and an operation position.

After step 156, the value of the register PRES1 is set in the register PRES2 in step 158, and the flow then returns to the main routine shown in FIG. 13.

If N in step 146, since this means that only position data of the pressure and position data is changed, processing operations in step 150 and subsequent steps are executed in the same manner as described above.

If Y in step 148, since this means that only pressure data of the pressure and position data is changed, processing operations in step 156 and subsequent steps are executed in the same manner as described above.

Modifications

The present invention is not limited to the above embodiment, and various changes and modifications may be made. For example, the following modifications are available.

(1) The present invention is not limited to a polyphonic electronic musical instrument but may be applied to a monophonic electronic musical instrument.

(2) The position and pressure detection means are not limited to a combination of the slide register and the pressure sensor. Various other means, for example, a combination of a linear encoder and a pressure sensor (this means requires no A/D conversion of position data), may be employed.

(3) Conversion characteristics of the pressure/position conversion memory are not limited to those shown in FIGS. 4 to 6. Various other characteristics may be employed. The interpolation calculations need not always be linear interpolations, but may be other interpolations. In addition, when tone generator control pressure data is generated by calculations, a calculation formula is not limited to that described above.

As described above, according to the present invention, since musical tone characteristics are controlled in accordance with pressure data which is varied according to an operation position even if an operation pressure remains the same, performance expressions imitating down-bow and up-bow expressions of a bowed instrument can be obtained. For example, a bow (or operation member) is operated from the base side toward the tip side to generate a tone which strongly begins in "détaché", or is operated from the tip side toward the base side to generate a tone which naturally crescendos, or is operated at the base side to generate strong tremolo tones, or is operated at the tip side to generate weak tremolo tones. Thus, various performance expressions can be obtained.

What is claimed is:

1. A musical tone control apparatus for manually controlling the musical tone of an electronic musical instrument, comprising:

an operation member which can be movably operated in a predetermined direction;

first detection means for detecting the position of said operation member along said detection of movement and outputting position data representative of said position;

second detection means for detecting pressure applied to said operation member and outputting pressure data representative of the amount of pressure so applied;

conversion means for converting the pressure data outputted from said second detection means into control pressure data on the basis of the position data outputted from said first detection means, said conversion means performing conversion such that a value of the control pressure data is changed according to the position of the operation member along the moving direction if said pressure applied to said operation member is assumed to be constant; and control means for controlling musical tone characteristics in accordance with the control pressure data from said conversion means.

2. A musical tone control apparatus comprising:

an operator;

first detecting means for detecting a pressure applied to the operator and outputting a pressure signal;

second detecting means for detecting a position of the operator and outputting a position signal;

memory means for storing pressure transforming characteristics representing relationships between the pressure signal outputted from said first detecting means and a control pressure signal determinative of control of musical tone, said pressure transforming characteristics varying in accordance with the position signal outputted from said second detecting means; and control means for controlling musical tones in accordance with the control pressure signal read out from said memory means.

3. A musical tone controlling apparatus according to claim 2, wherein said operator is a slidable resistor.

4. A musical tone control apparatus for an electronic musical instrument, said electronic musical instrument comprising: a closed loop circuit for circulating waveform data; a variable delay, provided in said loop, for controlling the circulation of said waveform data through said loop to thereby determine a pitch of a musical tone; and nonlinear function converting means for converting said waveform data according to a nonlinear function and outputting such converted waveform data back into said loop;

said musical tone control apparatus comprising:

an operator which can be movably operated in a predetermined direction and simulates a bow, position of said operator in said predetermined direction corresponding to position of the bow;

first detection means for detecting position data of said operator along said direction;

second detection means for detecting pressure data applied to said operator;

converting means for converting the pressure data outputted from said second detection means into control pressure data which controls said nonlinear function converting means; and control means for controlling musical tone characteristics in accordance with the control pressure data from said conversion means.

5. A musical tone control apparatus according to claim 4, wherein said converting means includes a memory which stores a plurality of nonlinear converting characteristics between the pressure data and the control pressure data.

6. A musical tone control apparatus according to claim 4, wherein said converting means converts the pressure data into the control pressure data in accordance with another nonlinear converting characteristic when the pressure data outputted from said first detection means is constant.

7. A method for controlling a musical tone comprising the steps of:

providing an operator;

detecting a pressure on the operator and outputting a pressure signal in accordance with a detected pressure;

detecting a position of the operator and outputting a position signal distinct from said pressure signal in accordance with the detected position;

generating a tone control pressure signal based on the pressure signal and varying in accordance with the position signal; and controlling a characteristic of the musical tone in accordance with said tone control pressure signal.

* * * * *